US007048411B2

(12) United States Patent
Tsao

(10) Patent No.: US 7,048,411 B2
(45) Date of Patent: May 23, 2006

(54) WIDE ANGLED LIGHTING FIXTURE

(76) Inventor: Frank Tsao, 5 Marram Court., Cleveland, QLD 4163 (AU)

( * ) Notice: Subject to any disclaimer, the term of this patent is extended or adjusted under 35 U.S.C. 154(b) by 75 days.

(21) Appl. No.: 10/801,144

(22) Filed: Mar. 16, 2004

(65) Prior Publication Data

US 2004/0212994 A1 Oct. 28, 2004

Related U.S. Application Data

(60) Provisional application No. 60/465,642, filed on Apr. 25, 2003.

(51) Int. Cl.
*F21V 1/10* (2006.01)

(52) U.S. Cl. ..... 362/239; 362/225

(58) Field of Classification Search ..... 362/11, 362/225, 227, 234, 236–240, 249–251, 296–298, 362/310, 410, 431, 260, 269, 224; 340/815.77; 607/94

See application file for complete search history.

(56) References Cited

U.S. PATENT DOCUMENTS 4,703,184 A * 10/1987 Wolff ..... 607/94
5,012,396 A * 4/1991 Costa ..... 362/224
5,752,766 A * 5/1998 Bailey et al. ..... 362/250
5,890,793 A * 4/1999 Stephens ..... 362/225
6,203,172 B1 * 3/2001 Wanuch et al. ..... 362/260
6,450,668 B1 * 9/2002 Kotloff ..... 362/269
6,585,395 B1 * 7/2003 Luk ..... 362/250
6,783,259 B1 * 8/2004 Macedonio ..... 362/251
6,820,997 B1 * 11/2004 Bissada ..... 362/216

* cited by examiner

*Primary Examiner*—Ali Alavi
*Assistant Examiner*—Hargobind S. Sawhney
(74) *Attorney, Agent, or Firm*—Raymond Y. Chan; David & Raymond

(57) ABSTRACT

A lighting fixture includes a light housing having two housing portions transversely extended at an adjacent angle less than 180 degrees to define a front angled opening, and a reflector having two reflecting portions received in the two housing portions of the light housing respectively wherein each of the reflecting portions of the reflector has a reflecting surface formed at an inner wall of the respective housing portion of the light housing. A light source arrangement includes two light sources, which are adapted for electrically connecting to a power source, supported within the two housing portions of the light housing respectively wherein the two light sources are arranged for producing lights to reflect on the two reflecting surfaces of the reflector respectively so as to project to outside through the front angled opening of the light housing with a wide projecting angle.

18 Claims, 5 Drawing Sheets

WIDE ANGLED LIGHTING FIXTURE

CROSS REFERENCE OF RELATED APPLICATION

This is a regular application of a provisional application, application No. 60/465,642, filed Apr. 25, 2003.

BACKGROUND OF THE PRESENT INVENTION

1. Field of Invention

The present invention relates to a lighting fixture, and more particularly to a wide angled lighting fixture which comprises two light sources received in a light housing with a front angled opening for enhancing the projecting angle of lighting fixture so as to minimize the shadowing area formed between the two light sources.

2. Description of Related Arts

Lighting fixtures are considered as one of the common illumination device since the lighting fixtures are effective and require low power operation such that most areas, such as warehouse or commercial buildings are illuminated by different kinds of lighting fixtures. For example, a typical lighting fixture is suspendedly mounted on a wall at a position above an entrance door or a garage door, the entrance area can be illuminated by the lighting fixture.

As shown in FIG. 1A, the lighting fixture generally comprises a supporting body arranged to mounted on the wall and at least two illuminating units adjustably supported on the supporting body wherein each of the illuminating units comprises a light housing having a reflecting inner surface and an illuminator disposed in the light housing in such a manner that the illuminating unit provides a projecting angle to illuminate a predetermined area. Accordingly, the projecting angle of each illuminating unit is about 119 degrees when a 500W of the illuminator is used.

In order to widen the wide projecting angle of the lighting fixture, which is defined by the sum of the two projecting angles of the illuminating units, each of the illuminating units is capable of being selectively adjusted with respect to the supporting body in such a manner that when the two illuminating units are turned apart with each other, the wide projecting angle of the lighting fixture will be substantially increased. However, such conventional lighting fixture has several drawbacks.

As shown in FIG. 1B, as it is mentioned above, when the two illuminating units are turned apart to increase the wide projecting angle of the lighting fixture, a shadowing area is created between the two illuminating units. In order to minimize the shadowing area of the lighting fixture, the two illuminating units must be turned towards to each other, which may narrowing the wide projecting angle of the lighting fixture. It is worth to mention that the structural design of each of the illuminating units cannot totally eliminate the shadowing area even though the two illuminating units are turned closely to each other.

In addition, the supporting body must provide an electric adapter electrically extended from the power source to electrically connect with the two illuminating units. Therefore, the lighting fixture requires a complicated electrical circuitry design to connect the two individual illuminating units with the power source so as to highly increase the manufacturing cost of the lighting fixture.

Furthermore, the conventional lighting fixture cannot be incorporated with a stand to elevate the illuminating units of the lighting fixture several feet off of the ground. However, due to the configuration of the supporting body, only one the lighting fixture can be supported on the stand. In other words, when two lighting fixture must be suspendedly supported above the ground, two individual stands must be employed respectively.

SUMMARY OF THE PRESENT INVENTION

A main object of the present invention is to provide a wide angled lighting fixture which comprises two light sources received in a light housing with a front angled opening for enhancing the projecting angle of lighting fixture.

Another object of the present invention is to provide a wide angled lighting fixture, wherein the light housing functions as one single illumination unit having two light sources to provide a wider light projecting angle in comparison with the conventional illumination unit.

Another object of the present invention is to provide a wide angled lighting fixture, wherein no divider is formed between the two light sources within the light housing to block the lights from the light sources respectively, a shadowing area formed between the two light sources can be substantially eliminated.

Another object of the present invention is to provide a wide angled lighting fixture, wherein the lighting fixture provides a simple structural design that the two light sources are supported within one light housing instead of two individual light housings, so as to minimize the manufacturing cost of the lighting fixture of the present invention.

Another object of the present invention is to provide a wide angled lighting fixture, wherein the electrical connecting configuration is simple that by directly wiring the power source to the two light sources within the same light housing in comparison with the conventional configuration that the power source must be electrically wired with two light sources within two individual light housings respectively.

Another object of the present invention is to provide a wide angled lighting fixture which is adapted to incorporate with a stand to elevate the lighting fixture several feet off of the ground by directly mounting the light housing on the stand. In other words, one single stand is capable of supporting two or more lighting fixtures at the same time to even widen the projecting angle thereof.

Another object of the present invention is to provide a wide angled lighting fixture, wherein no expensive or complicated mechanism is required to employ in the lighting fixture, so that the present invention successfully provides an economic and efficient solution not only for enhancing the projecting angle of the lighting fixture but also for eliminating the shadowing area thereof, so as to facilitate the practical use of the lighting fixture.

Accordingly, in order to accomplish the above objects, the present invention provides a wide angled lighting fixture, comprising:

a light housing having two housing portions transversely extended at an adjacent angle less than 180 degrees to define a front angled opening;

a reflector having two reflecting portions received in the two housing portions of the light housing respectively wherein each of the reflecting portions of the reflector has a reflecting surface formed at an inner wall of the respective housing portion of the light housing; and a light source arrangement comprising two light sources, which are adapted for electrically connecting to a power source, supported within the two housing portions of the light housing respectively wherein the two light sources are arranged for producing lights to reflect on the two reflecting surfaces of the reflector respectively so as to project to outside through the front angled opening of the light housing with a wide projecting angle.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
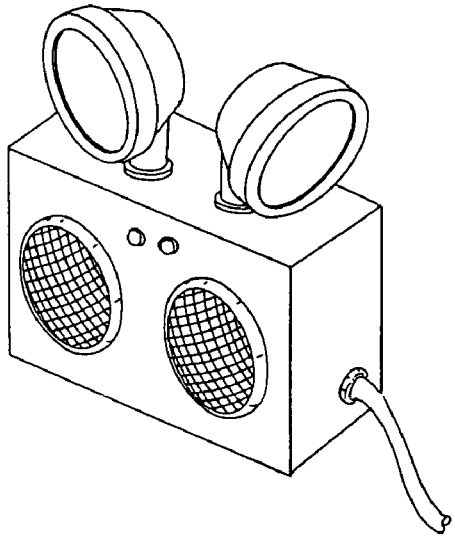
FIG. 1A PRIOR ART
FIG. 1A is a perspective view of a conventional lighting fixture.
Figure 1B:
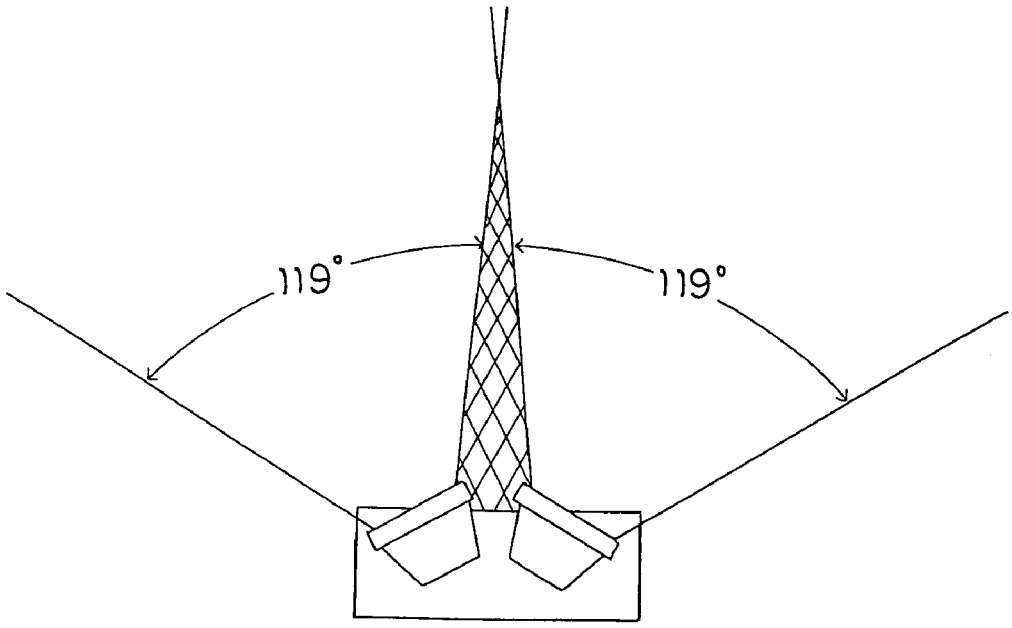
FIG. 1B PRIOR ART
FIG. 1B is a top view of the conventional lighting fixture, illustrating the shadowing area created between the two illuminating units.
Figure 2:
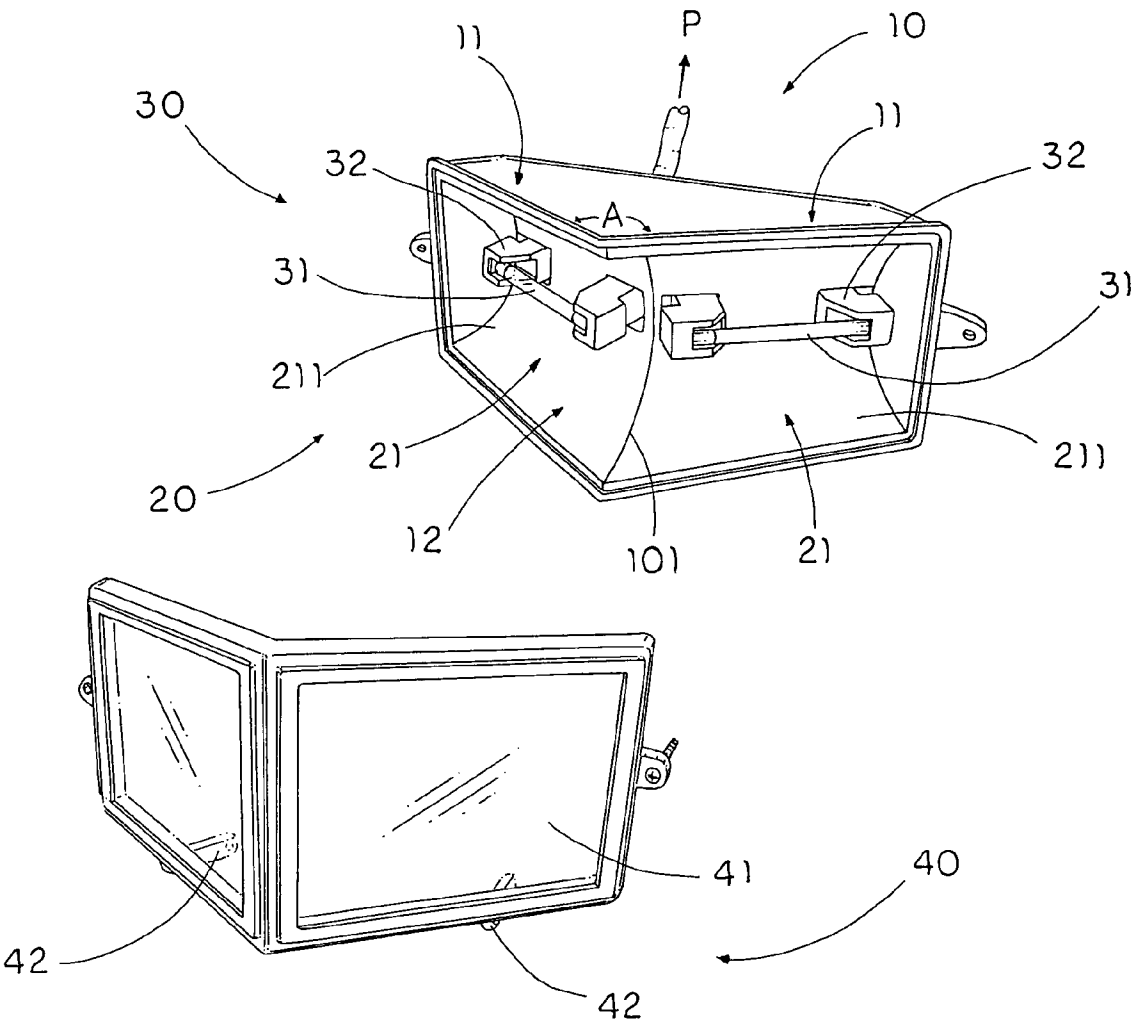
FIG. 2 is a partially exploded perspective view of a wide angled lighting fixture according to a preferred embodiment of the present invention.
Figure 3:
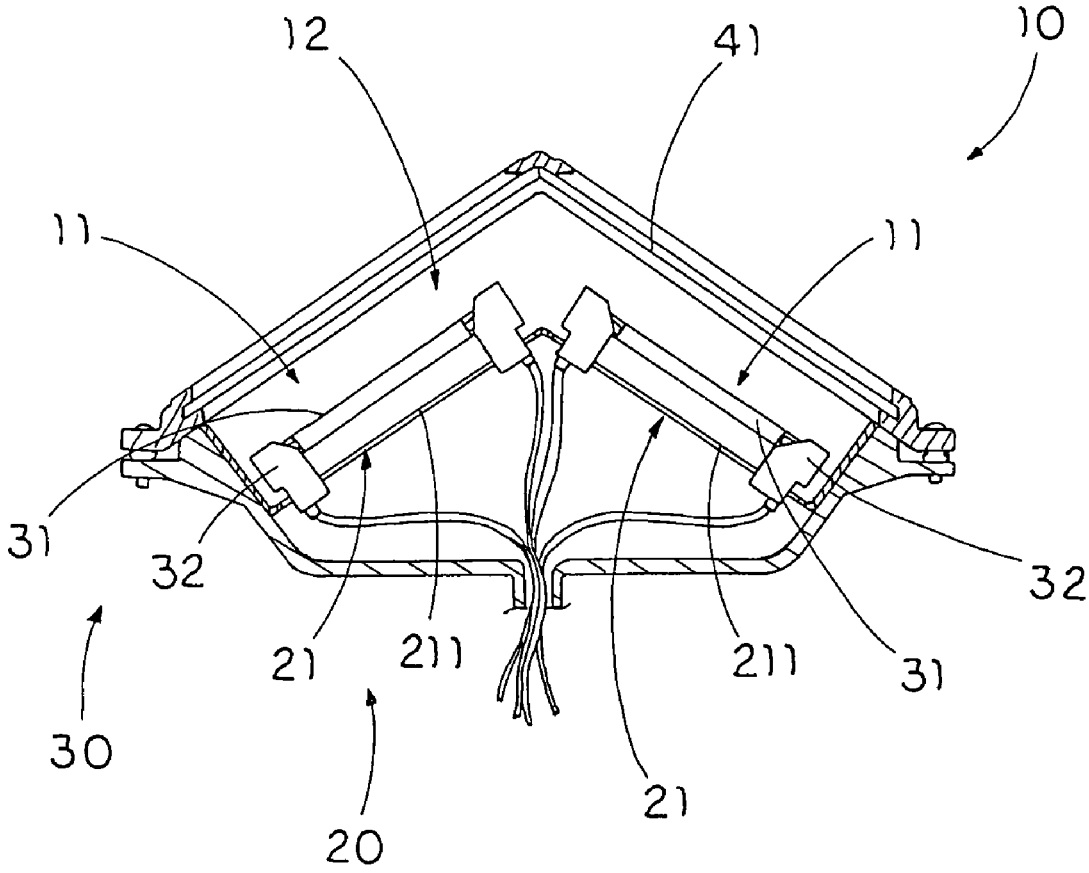
FIG. 3 is a sectional view of the wide angled lighting fixture according to the above preferred embodiment of the present invention.

Referring to FIGS. 2 and 3 of the drawings, a wide angled lighting fixture according to a preferred embodiment is illustrated, wherein the wide angled lighting fixture comprises a light housing 10 having two housing portions 11 transversely extended at an adjacent angle A less than 180 degrees to define a front angled opening 12, a reflector 20, and a light source arrangement 30.

The reflector 20 has two reflecting portions 21 received in the two housing portions 11 of the light housing 10 respectively wherein each of the reflecting portions 21 of the reflector 20 has a reflecting surface 211 formed at an inner wall of the respective housing portion 11 of the light housing 10.

The light source arrangement 30 comprises two light sources 31, which are adapted for electrically connecting to a power source P, supported within the two housing portions 11 of the light housing 10 respectively wherein the two light sources 31 are arranged for producing lights to reflect on the two reflecting surfaces 211 of the reflector 20 respectively so as to project to outside through the front angled opening 12 of the light housing 10 with a wide projecting angle $\alpha$.

According to the preferred embodiment, the light housing 10 is shaped to have a triangular cross section wherein the two inner walls of the housing portions 11 of the light housing 10 are longitudinally extended to form a common line-edge 101 where the two inner walls of the housing portions 11 meet with each other so as to define the adjacent angle A between the two inner walls of the housing portions 11 of the light housing 10. The adjacent angle A of the light housing 10 is an obtuse angle which is an angle between 90 degrees and 180 degrees. Preferably, the adjacent angle A of the light housing 10 has a value of 120 degrees to optimize the lights projecting from the front angled opening 12 of the light housing 10.

As shown in FIG. 3, the two housing portions 11 of the light housing 10 are adapted to be communicated with each other in such a manner that the light produced by each of the light sources 31 is capable of passing from the respective housing portion 11 of the light housing 10 to the other housing portion 11 thereof.

The two reflecting portions 21 of the reflector 20 are supported within the two housing portions 11 of the light housing 10 respectively in such a manner that the two reflecting portions 21 of the reflector 20 are longitudinally extended at the adjacent angle A of the light housing while the two reflecting surfaces 211 of the reflector 20 are integrally extended in a longitudinal direction to meet with each other at the common line-edge 101.

The reflecting surface 211 of each of the reflecting portions 21 of the reflector 20, having a predetermined curvature, is formed at the inner wall of the respective housing portion 11 of the light housing 10, wherein the two light sources 31 of the light source arrangement 30 are supported within the two housing portions 11 of the light housing 10 at two focus points of the reflecting surfaces 211 of the reflector 20 respectively. Therefore, the lights produced by the light sources 31 can be effectively reflected on the reflecting surface 211 to enhance the intensity of the light to project out of the light housing 10 through the front angled opening 12 thereof.

It is worth to mention that the reflector 20 can be formed in the light housing 10 by coating the two reflecting surfaces 211 on the inner walls of the housing portions 11 of the light housing 10 respectively in such a manner that each of the housing portions 11 of the light housing 10 forms as a reflecting bowl having an inner reflective surface for reflecting the light from the respective light source 31 at the focus point of the reflecting bowl to outside.

As shown in FIG. 3, the light source arrangement 30 further comprises two electric sockets 32 supported within the two housing portions 11 of the light housing 10 to retain the two light sources 31 at the focus point of the reflecting surfaces 211 respectively. Accordingly, the electric sockets 32 are electrically connected to the power source P in such a manner that the electric sockets 32 are not only arranged to hold the light sources 31 in position but also electrically connected the light sources 31 with the power source P. It is worth to mention that the two light sources 31 are directly connected to the power source P via one single light housing 10 such that the electrical connection of the lighting fixture of the present invention can be simplified, so as to minimize the manufacturing cost of the light housing 10 incorporating with two light sources 31 therein.

The light sources 31 are two replaceable halogen light bulbs supported within the housing portions 11 of the light housing 10 via the electric sockets 32 at the focus points of the reflecting surfaces 211 respectively, wherein each of the light sources 31 provides a light projecting angle $\theta$ when the light is projecting out of the respective housing portion 11 of the light housing 10 through the front angled opening 12 thereof.

Figure 4:
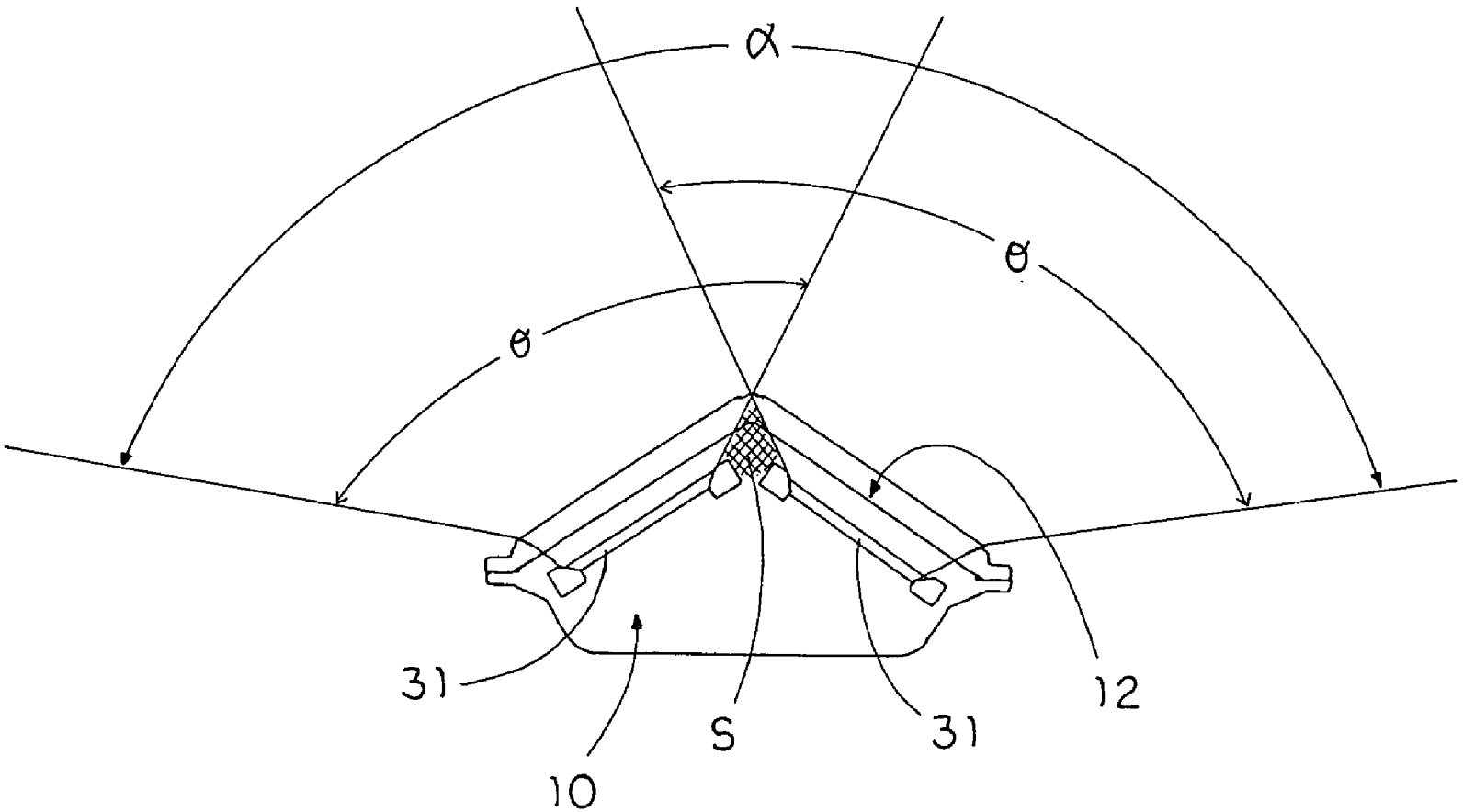
FIG. 4 illustrates the shadowing area created between two light sources at a position within the light housing of the wide angled lighting fixture according to the above preferred embodiment of the present invention.

Therefore, when the two light sources 31 are switched on to project the lights through the front angled opening 12 of the light housing 10, the wide projecting angle $\alpha$ of the lighting fixture is defined that a coverage area formed within the two light projecting angles $\theta$ of the light sources 31. As shown in FIG. 4, the wide projecting angle $\alpha$ of the lighting fixture is about 162 degrees when two 250W of light sources 31 are used, which is larger than the wide projecting angle of the conventional lighting fixture while the same volt of the light source is used.

As it is mentioned in the background, when the two light sources 31 produce lights at the same time, a shadowing area S is formed between the two light sources 31 wherein the shadowing area S is defined at an area that the two light projecting angles θ are not overlapped with each other, as shown in FIG. 4. Since the housing portions 11 of the light housing 10 are extended longitudinally, the shadowing area S is formed at a position within the light housing 10 in such a manner that the light projecting angles θ of the light sources 31 are overlapped with each other at the front angled opening 12 of the light housing 10. Therefore, no shadowing area is formed by the light sources 31 outside the light housing 10 such that the lighting fixture of the present invention provides a continuously lighting area within the wide projecting angle α thereof. In other words, the structural configuration of the light housing 10 can effectively eliminate the shadowing area created between the two light sources 31.

As shown in FIG. 2, the lighting fixture further comprises an angled opening shelter 40 which comprises a sheltering window 41 shaped and sized to fittingly cover at the front angled opening 12 of the light housing 10 and two pivot arms 42 integrally extended from the sheltering window 41 to pivotally connect to the light housing 10 in such a manner that the sheltering window 41 is capable of pivotally folding to a closed position that the sheltering window 41 is cover on the front angled opening 12 of the light housing 10 to protect the light sources 31 therein and to an opened position that the light sources 31 within the light housing 10 are exposed to outside.

Figure 5:
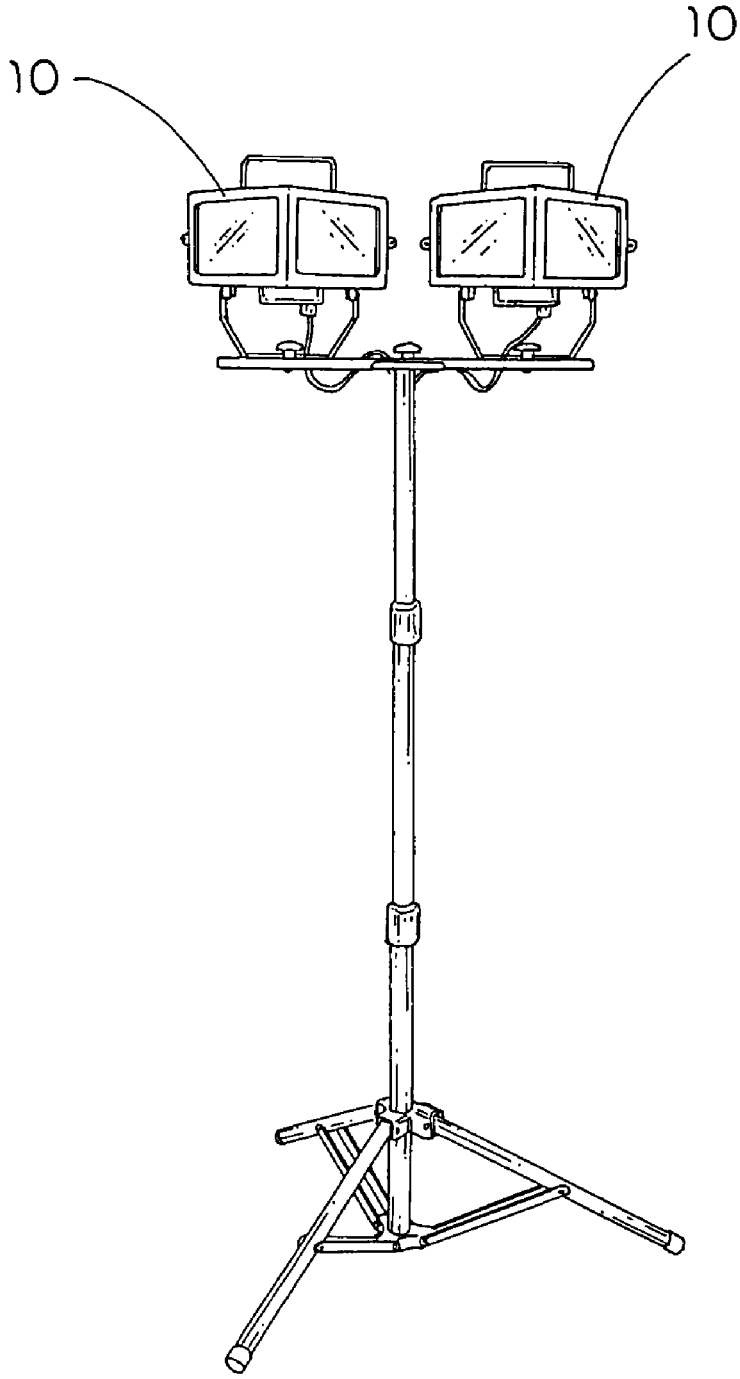
FIG. 5 illustrates two or more lighting fixtures being supported on a stand according to the above preferred embodiment of the present invention.

Since the two light sources 31 are mounted within one light housing 10, the lighting fixture of the present invention can be simply mounted on the wall by directly attaching the light housing 10 on the wall. Likewise, two or more lighting fixtures of the present invention can be directly supported on one single stand, as shown in FIG. 5, so as to further widen the coverage area by the lighting fixtures. In other words, the lighting fixture of the present invention provides a simple structural design that the light housing 10 of the lighting fixture functions as one single illumination unit to provide an even wider projecting angle in comparison with the conventional illumination unit.

It is worth to mention that the light housing 10 can further has an additional housing portion longitudinally extended from one of the two housing portions 11 at the adjacent angle A to receive an additional reflecting portion of the reflector 20 so as to form an additional reflecting surface on an inner wall of the additional housing portion of the light housing 10 wherein an additional light source is supported within the additional housing portion at a focus point of the additional reflecting surface. In other words, more than three light sources 31 can be mounted within one single light housing 10 which has a corresponding number of housing portions 11 so as to further widen the wide projecting angle α of the lighting fixture while no shadowing area is formed between each two light sources 31.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A lighting fixture, comprising:

a light housing having two housing portions transversely extended at an adjacent angle less than 180 degrees to define a front angled opening;

a reflector having two reflecting portions received in said two housing portions of said light housing respectively wherein each of said reflecting portions of said reflector has a reflecting surface formed at an inner wall of said respective housing portion of said light housing; and a light source arrangement comprising two light sources, which are adapted for electrically connecting to a power source, supported within said two housing portions of said light housing respectively wherein said two light sources are arranged for producing lights to reflect on said two reflecting surfaces of said reflector respectively so as to project to outside through said front angled opening of said light housing, wherein said two inner walls of said housing portions of said light housing are longitudinally extended to form a common line-edge where said two inner walls of said housing portions meet with each other so as to define said adjacent angle between said two inner walls of said housing portions of said light housing such that said two housing portions of said light housing are adapted to be communicated with each other.

2. The lighting fixture, as recited in claim 1, wherein said adjacent angle of said light housing is an obtuse angle which is an angle between 90 degrees and 180 degrees.

3. The lighting fixture, as recited in claim 2, wherein said two reflecting portions of said reflector are longitudinally extended at said adjacent angle of said light housing while the two reflecting surfaces of said reflector are integrally extended in a longitudinal direction to meet with each other at said common line-edge.

4. The lighting fixture, as recited in claim 3, wherein said reflecting surface of each of said reflecting portions of said reflector, having a predetermined curvature, is formed at said inner wall of said respective housing portion of said light housing, wherein said two light sources of said light source arrangement are supported within said two housing portions of said light housing at two focus points of said reflecting surfaces of said reflector respectively.

5. The lighting fixture, as recited in claim 4, wherein a shadowing area, which is defined between said two light sources at a non-overlapped area between two light projecting angles respectively provided by said light sources, is formed at a position within said light housing.

6. The lighting fixture, as recited in claim 5, further comprising an angled opening shelter which comprises a sheltering window shaped and sized to fittingly cover at said front angled opening of said light housing and two pivot arms integrally extended from said sheltering window to pivotally connect to said light housing in such a manner that said sheltering window is capable of pivotally folding to a closed position that said sheltering window is cover on said front angled opening of said light housing to protect said light sources therein and to an opened position that said light sources within said light housing are exposed to outside.

7. The lighting fixture, as recited in claim 6, wherein said light source arrangement further comprises two electric socket supported within said two housing portions of said light housing to hold said two light sources in position respectively, wherein said electric sockets are arranged for electrically connecting with said power source so as to electrically connect said light sources with said power source.

8. The lighting fixture, as recited in claim 5, wherein said light source arrangement further comprises two electric socket supported within said two housing portions of said light housing to hold said two light sources in position respectively, wherein said electric sockets are arranged for electrically connecting with said power source so as to electrically connect said light sources with said power source.

9. The lighting fixture, as recited in claim 4, further comprising an angled opening shelter which comprises a sheltering window shaped and sized to fittingly cover at said front angled opening of said light housing and two pivot arms integrally extended from said sheltering window to pivotally connect to said light housing in such a manner that said sheltering window is capable of pivotally folding to a closed position that said sheltering window is cover on said front angled opening of said light housing to protect said light sources therein and to an opened position that said light sources within said light housing are exposed to outside.

10. The lighting fixture, as recited in claim 4, wherein said light source arrangement further comprises two electric socket supported within said two housing portions of said light housing to hold said two light sources in position respectively, wherein said electric sockets are arranged for electrically connecting with said power source so as to electrically connect said light sources with said power source.

11. The lighting fixture, as recited in claim 3, wherein a shadowing area, which is defined between said two light sources at a non-overlapped area between two light projecting angles respectively provided by said light sources, is formed at a position within said light housing.

12. The lighting fixture, as recited in claim 3, further comprising an angled opening shelter which comprises a sheltering window shaped and sized to fittingly cover at said front angled opening of said light housing and two pivot arms integrally extended from said sheltering window to pivotally connect to said light housing in such a manner that said sheltering window is capable of pivotally folding to a closed position that said sheltering window is cover on said front angled opening of said light housing to protect said light sources therein and to an opened position that said light sources within said light housing are exposed to outside.

13. The lighting fixture, as recited in claim 2, wherein said reflecting surface of each of said reflecting portions of said reflector, having a predetermined curvature, is formed at said inner wall of said respective housing portion of said light housing, wherein said two light sources of said light source arrangement are supported within said two housing portions of said light housing at two focus points of said reflecting surfaces of said reflector respectively.

14. The lighting fixture, as recited in claim 1, wherein said two reflecting portions of said reflector are longitudinally extended at said adjacent angle of said light housing while the two reflecting surfaces of said reflector are integrally extended in a longitudinal direction to meet with each other at said common line-edge.

15. The lighting fixture, as recited in claim 1, wherein said reflecting surface of each of said reflecting portions of said reflector, having a predetermined curvature, is formed at said inner wall of said respective housing portion of said light housing, wherein said two light sources of said light source arrangement are supported within said two housing portions of said light housing at two focus points of said reflecting surfaces of said reflector respectively.

16. A lighting fixture, comprising:

a light housing having two housing portions transversely extended at an adjacent angle less than 180 degrees to define a front angled opening;

a reflector having two reflecting portions received in said two housing portions of said light housing respectively wherein each of said reflecting portions of said reflector has a reflecting surface formed at an inner wall of said respective housing portion of said light housing; and a light source arrangement comprising two light sources, which are adapted for electrically connecting to a power source, supported within said two housing portions of said light housing respectively wherein said two light sources are arranged for producing lights to reflect on said two reflecting surfaces of said reflector respectively so as to project to outside through said front angled opening of said light housing, wherein said reflecting surface of each of said reflecting portions of said reflector, having a predetermined curvature, is formed at said inner wall of said respective housing portion of said light housing, wherein said two light sources of said light source arrangement are supported within said two housing portions of said light housing at two focus points of said reflecting surfaces of said reflector respectively.

17. The lighting fixture, as recited in claim 16, wherein a shadowing area, which is defined between said two light sources at a non-overlapped area between two light projecting angles respectively provided by said light sources, is formed at a position within said light housing.

18. A lighting fixture, comprising:

a light housing having two housing portions transversely extended at an adjacent angle less than 180 degrees to define a front angled opening;

a reflector having two reflecting portions received in said two housing portions of said light housing respectively wherein each of said reflecting portions of said reflector has a reflecting surface formed at an inner wall of said respective housing portion of said light housing;

a light source arrangement comprising two light sources, which are adapted for electrically connecting to a power source, supported within said two housing portions of said light housing respectively wherein said two light sources are arranged for producing lights to reflect on said two reflecting surfaces of said reflector respectively so as to project to outside through said front angled opening of said light housing; and an angled opening shelter which comprises a sheltering window shaped and sized to fittingly cover at said front angled opening of said light housing and two pivot arms integrally extended from said sheltering window to pivotally connect to said light housing in such a manner that said sheltering window is capable of pivotally folding to a closed position that said sheltering window is cover on said front angled opening of said light housing to protect said light sources therein and to an opened position that said light sources within said light housing are exposed to outside.

* * * * *